US007710266B2

(12) United States Patent
Belden, Jr. et al.

(10) Patent No.: US 7,710,266 B2
(45) Date of Patent: May 4, 2010

(54) SECURITY SYSTEM WITH PRODUCT POWER CAPABILITY

(75) Inventors: Dennis D. Belden, Jr., Canton, OH (US); Christopher J. Fawcett, Charlotte, NC (US); Anthony M. Cupolo, Mableton, GA (US)

(73) Assignee: Invue Security Products Inc., Charlotte, NC (US)

( * ) Notice: Subject to any disclaimer, the term of this patent is extended or adjusted under 35 U.S.C. 154(b) by 216 days.

(21) Appl. No.: 11/970,146

(22) Filed: Jan. 7, 2008

(65) Prior Publication Data

US 2008/0169923 A1 Jul. 17, 2008

Related U.S. Application Data

(60) Provisional application No. 60/880,115, filed on Jan. 12, 2007, provisional application No. 60/880,132, filed on Jan. 12, 2007.

(51) Int. Cl.
*G08B 13/12* (2006.01)

(52) U.S. Cl. ..... 340/568.3; 340/568.2; 340/568.8; 340/571; 439/505; 439/917

(58) Field of Classification Search ..... 340/568.3, 340/568.1, 568.2, 568.4, 568.8, 571, 686.1, 340/686.6; 439/501, 505, 527, 917
See application file for complete search history.

(56) References Cited

U.S. PATENT DOCUMENTS

| | | | | |
|---|---|---|---|---|
| 3,710,224 | A | 1/1973 | Daniels | |
| 4,598,827 | A | 7/1986 | Keifer | |
| 4,618,857 | A | 10/1986 | Dubois et al. | |
| 4,620,182 | A | 10/1986 | Keifer | |
| 5,341,124 | A | 8/1994 | Leyden et al. | |
| 5,517,175 | A | 5/1996 | Brown et al. | |
| 5,604,484 | A | 2/1997 | Rogers | |
| 5,617,073 | A | 4/1997 | Wilson | |
| 5,838,225 | A | 11/1998 | Todd | |
| 5,861,807 | A * | 1/1999 | Leyden et al. | 340/568.2 |
| 5,886,633 | A | 3/1999 | Adams | |
| 6,104,289 | A | 8/2000 | Rand | |
| 6,150,940 | A | 11/2000 | Chapman et al. | |
| 6,380,855 | B1 | 4/2002 | Ott | |
| 6,386,906 | B1 | 5/2002 | Burke | |
| 6,476,717 | B1 | 11/2002 | Gross et al. | |

(Continued)

*Primary Examiner*—Davetta W Goins
(74) *Attorney, Agent, or Firm*—Christopher C. Dremann, P.C.

(57) ABSTRACT

A security system and display module therefore protects an item of merchandise mounted on the display module in a retail environment. The item of merchandise is electrically and mechanically connected to a sensor which is removably mounted on the display module by a first power cord. A second power cord connects the display module to the sensor and a third power cord connects the display module to a source of electricity for supplying electric power to the sensor through the display module and then to the displayed item for maintaining the charge on a battery of the displayed item. The display module contains an alarm unit having an audible alarm which is actuated if the integrity of either of the first or second power cords is compromised. A plunger switch and LED may be contained in the sensor and in a base of the display module and connected to the internal alarm to provide additional security for the protected item of merchandise. The alarm is powered from the source of electricity but is automatically switched to the battery upon interruption of this power source.

44 Claims, 7 Drawing Sheets

U.S. PATENT DOCUMENTS

| | | | |
|---|---|---|---|
| 6,509,659 | B1 | 1/2003 | Carroll et al. |
| 6,570,502 | B2 | 5/2003 | Matsuo |
| 6,690,277 | B1 | 2/2004 | Hansen et al. |
| 6,756,900 | B2 | 6/2004 | Leyden et al. |
| 6,761,579 | B2 | 7/2004 | Fort et al. |
| 6,799,994 | B2 | 10/2004 | Burke |
| 6,836,214 | B2 | 12/2004 | Choi |
| 6,896,543 | B2 | 5/2005 | Fort et al. |
| 6,956,479 | B2 | 10/2005 | Kelsch et al. |
| 7,011,009 | B1 | 3/2006 | Tomich |
| 7,015,596 | B2 | 3/2006 | Pail |
| 7,327,276 | B1 * | 2/2008 | Deconinck et al. ..... 340/687 |
| 2006/0097875 | A1 | 5/2006 | Ott |
| 2006/0145848 | A1 | 7/2006 | Marsilio et al. |
| 2006/0214790 | A1 | 9/2006 | Masciantonio |

* cited by examiner

| FIG-2A | FIG-2B |
|---|---|

SECURITY SYSTEM WITH PRODUCT POWER CAPABILITY

CROSS REFERENCE TO RELATED APPLICATIONS

This application claims priority from U.S. Provisional Application Ser. No. 60/880,115 filed Jan. 12, 2007 and U.S. Provisional Application Ser. No. 60/880,132 filed Jan. 12, 2007; the disclosures of which are incorporated herein by reference.

BACKGROUND OF THE INVENTION

1. Technical Field

The invention relates to security systems for the display of items of merchandise in a retail establishment. More particularly, the invention relates to a security system which supplies power to a product displayed in a secured condition on a sensor supported on a display module for charging the internal battery of the product or supplying electricity for controlling other features of the displayed product. The invention furthermore relates to an individual display module which contains an internal alarm dedicated to protecting a single product secured to a sensor supported on the display module.

2. Background Information

Retail stores have had a difficult time protecting items of merchandise which the potential customer wishes to visually inspect and handle prior to making the decision to purchase the items. Often such items have been keep in a glass case under lock and key which does not allow a customer to handle the item without assistance of store personnel. In addition, while such items may be secured to a display shelf or base by a cable or the like, this does not necessarily prevent the theft of the item by cutting of the cable or detaching the product from the cable.

Therefore, various security systems and devices have been developed which include a unique display module secured to a support surface such as a display shelf, which supports a sensor that is attached to an item of merchandise and which is mechanically and electrically connected by a lanyard or power cord to the display module. This enables a potential customer to pick up and handle the item such as a cell phone, camera, mini DVDs, MP3 players and the like, prior to purchasing the item, while the item is maintained connected to the display module. These display modules and sensors are provided with switches which will actuate an alarm contained in the display module if the item is removed from the sensor, or the module removed from its support surface, or if a connecting power cord is severed or tampered with in an unauthorized manner. These security systems utilizing such display modules and sensors have proven satisfactory for many retail security applications.

However, one problem has developed in the display of various items of merchandise which require a source of power, usually provided by an internal battery, such as digital cameras, music players, cell phones, mini DVD players, MP3 players etc. After the product has been displayed for a period of time, the battery will loose charge resulting in the product being inoperable requiring constant recharging of the battery by store personnel.

Another problem with prior art security systems is that multiple display modules are connected to a central alarm system and power supply which makes it difficult to rapidly determine which display module or attached product caused the central alarm to be actuated. Furthermore, the alarm system has to be deactivated each time one of the display modules or product displayed thereon is being replaced or modified.

Therefore, the need exists for a security system, and in particular a display module therefore which contains its own alarm system and power supply, and which supports a security sensor which is attached to an item of merchandise, and in which electric power can be supplied to the protected item from a remote source of power to maintain a charge on the internal battery of the item or supply electric power to other components of the item of merchandise. Furthermore, there is a need for a display module which has a self-contained alarm which protects the product secured thereon enabling the display module to be placed at various locations without being attached to a central alarm system or remote source of electric power.

BRIEF SUMMARY OF THE INVENTION

One aspect of the present invention is to provide a security system which includes a unique display module which supports a sensor that is attached to an item of merchandise with an alarm system being self-contained in the display module and which sounds an alarm should a thief attempt to remove the item of merchandise from the attached sensor or the display module from the display location.

Another feature of the present invention is to provide a security system in which the display module has a power inlet port enabling electrical conductors to be easily connected to the power port and to a remote source of electricity so that electric power can be provided through the display module to the sensor for supplying electric power to the item of merchandise attached to the sensor for maintaining the charge on an internal battery of the item or for controlling other features of the protected item of merchandise requiring electric power, independent of the battery within the display module used to provide power for the alarm system.

A further feature of the present invention is to provide a security system in which either or both the display module and/or sensor has a visual indicator such as an LED, indicating to a clerk or potential thief that an alarm system is activated and that the displayed item of merchandise is protected by an alarm system.

Another aspect of the present invention is to enable the display module of the security system to be electrically and mechanically connected to the sensor by a lanyard or power cord which extends between the sensor and a power output port on the display module for supplying electric power through the sensor to the protected item of merchandise.

Another feature of the present invention is to provide either or both of the display module and sensor of the security system with a switch which is activated when the module is attached to a support structure and sensor attached to the item by automatically depressing a plunger switch to activate an internal alarm contained in the display module, which alarm is powered by a battery located within the display module.

Still another feature of the present invention is to provide a power input port on a base of the display module with a jack that is adapted to receive various types of connectors for supplying electric power to the item of merchandise through the security sensor from a remote source of electricity.

A further aspect of the present invention is that the power cord which connects the display module to the sensor contains a plurality of electrical conductors which are connected to the output port on the display module and to the internal alarm system with an easily attached removable connector to enable various sensors to be easily mounted on the display module, yet which will sound the internal alarm of the display module if the power cord is removed from the display module or the conductors thereof severed by a potential thief, and in which the power cord preferably contains six electrical conductors, two of which power a security plunger switch mounted within the sensor with two other of the conductors powering a visual indicator (LED) provided in the sensor, with the other two conductors being connected to a power output jack of the sensor from which electric power is supplied to the item of merchandise attached to the sensor.

Another feature of the invention is to provide the alarm module and sensor with a pair of magnets providing self-orientation of the displayed item when returned to the alarm module.

A further aspect of the invention is to provide the display module which displays a product in a secure position on a removable sensor mounted on the product with its own internal alarm system power by an internal battery to provide a one-to-one relationship, that is, each displayed product is protected by its own alarm system, even if an external source of electric power is not used to supply power to the displayed product.

A further feature of the present invention is to provide alarm circuitry in the display module in which an internal audible alarm is powered by an external power source connected to the display module and is automatically switched to an internal battery for powering the audible alarm in the event of a power failure or the unavailability of the external power source. This will extend the life of the internal battery and will provide another level of security to the security system of the present invention.

These objectives and features are obtained by the security system of the present invention for displaying and protecting a displayed product, the general nature of which may be stated as comprising a display module mounted on a support; a sensor removably mounted on the display module and connected to the displayed product; a remote source of electric power; a first power cord electrically connecting the display module to the source of electric power; a second power cord electrically and mechanically connecting the display module to the sensor; a third power cord electrically and mechanically connecting the sensor to the displayed product; wherein the first, second and third power cords provide an electrical path extending from the remote source of electric power through the display module and to the displayed product; and an alarm circuit contained in the display module having a self-contained power source providing sense loops through the second and third power cords and an audible alarm actuated upon the integrity of either of the second and third power cords being compromised.

DESCRIPTION OF THE SEVERAL VIEWS OF THE DRAWINGS

A preferred embodiment of the invention, illustrated of the best mode in which Applicant contemplates applying the principles, is set forth in the following description and is shown in the drawings and is particularly and distinctly pointed out and set forth in the appended claims.

Similar numbers refer to similar parts throughout the drawings.

DETAILED DESCRIPTION OF THE INVENTION

Figures 1, 2:
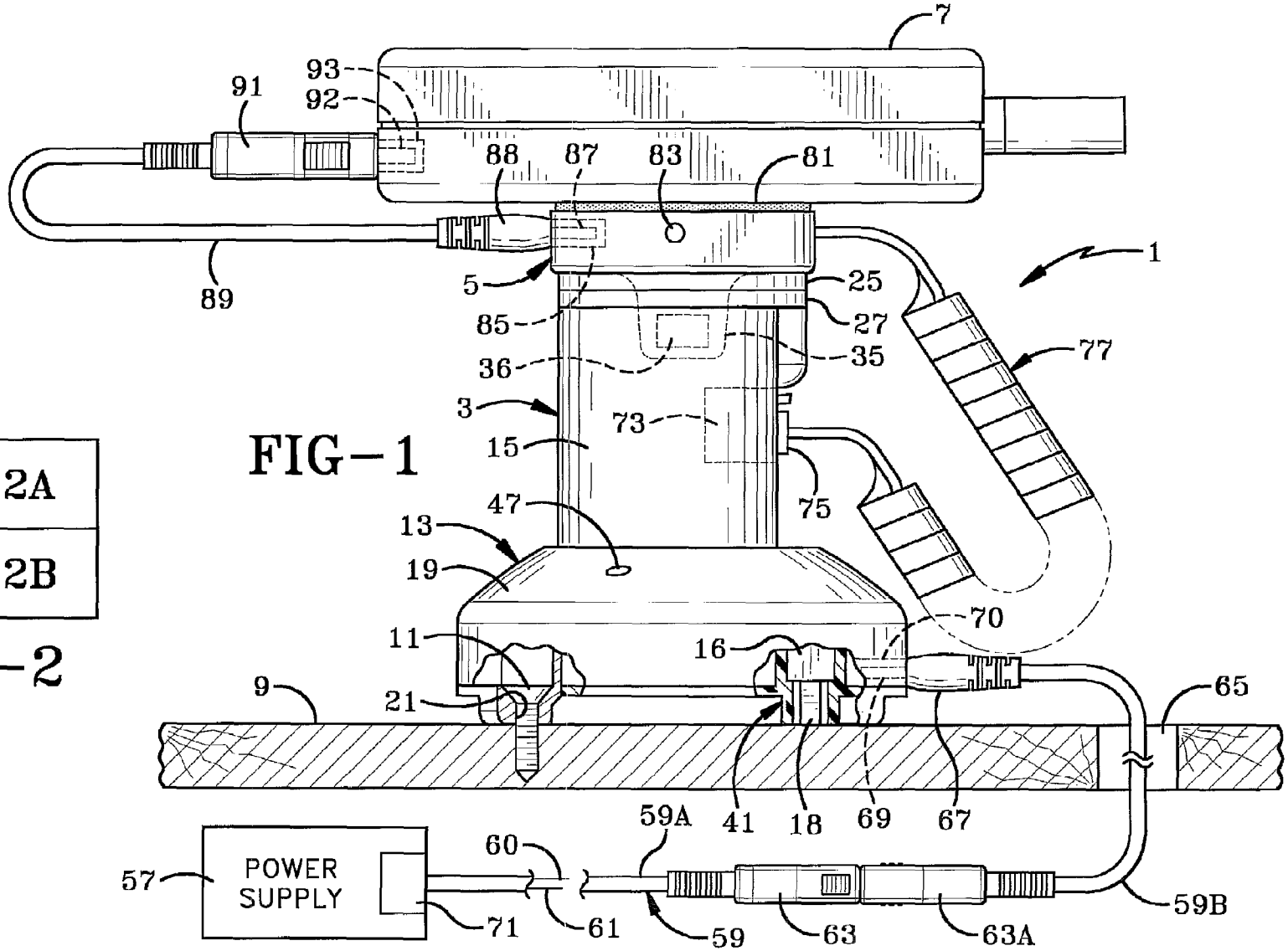
FIG. 1 is a side elevational view with portions in section of the security system and display module of the present invention.
FIG. 2 is an exploded perspective view of the display module component of the security system shown in FIGS. 2A and 2B.

The security system of the present invention is indicated generally at 1, and is shown particularly in FIG. 1. Security system 1 includes as its main component a display module indicated generally at 3 containing an internal alarm system, and a security sensor indicated generally at 5 for protecting a product or item of merchandise 7 attached to sensor 5. Product 7 is illustrated as a cell phone, but can be numerous types of products.

Figure 2A:
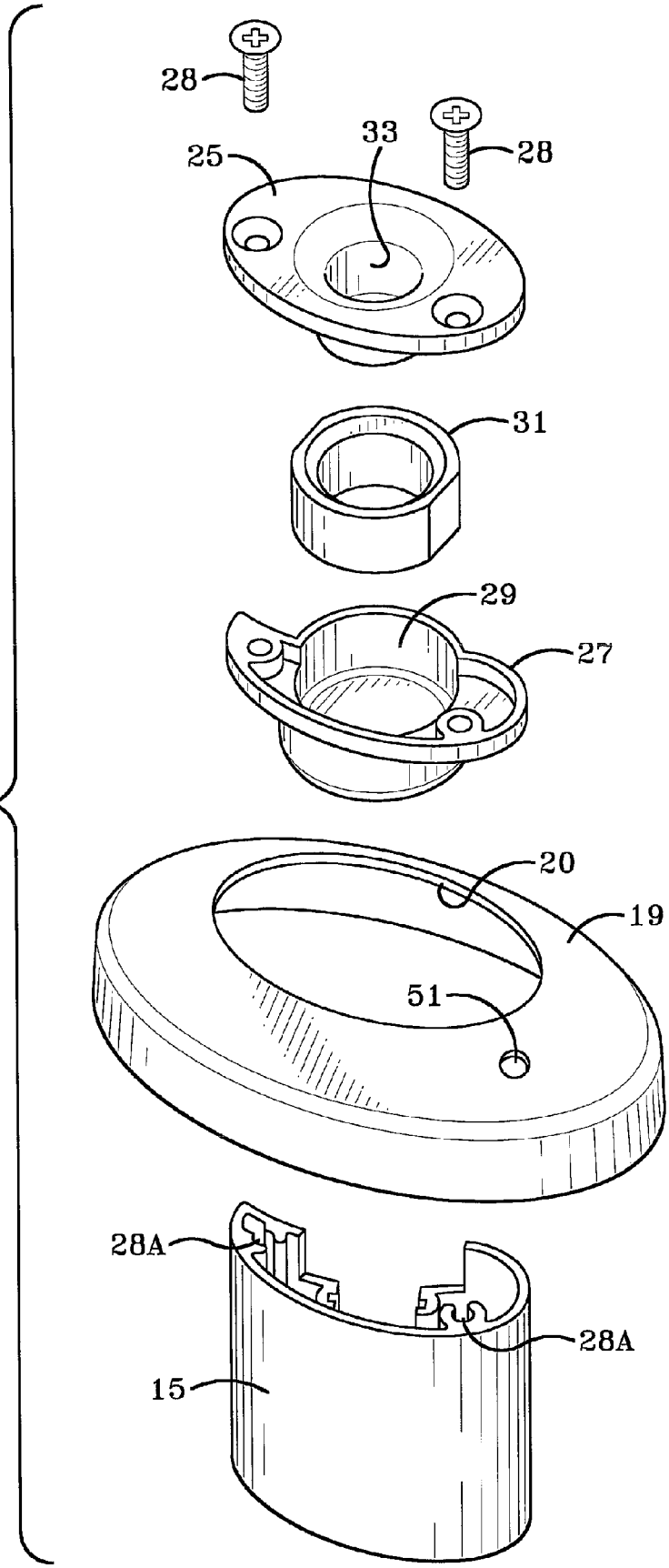
Figure 2B:
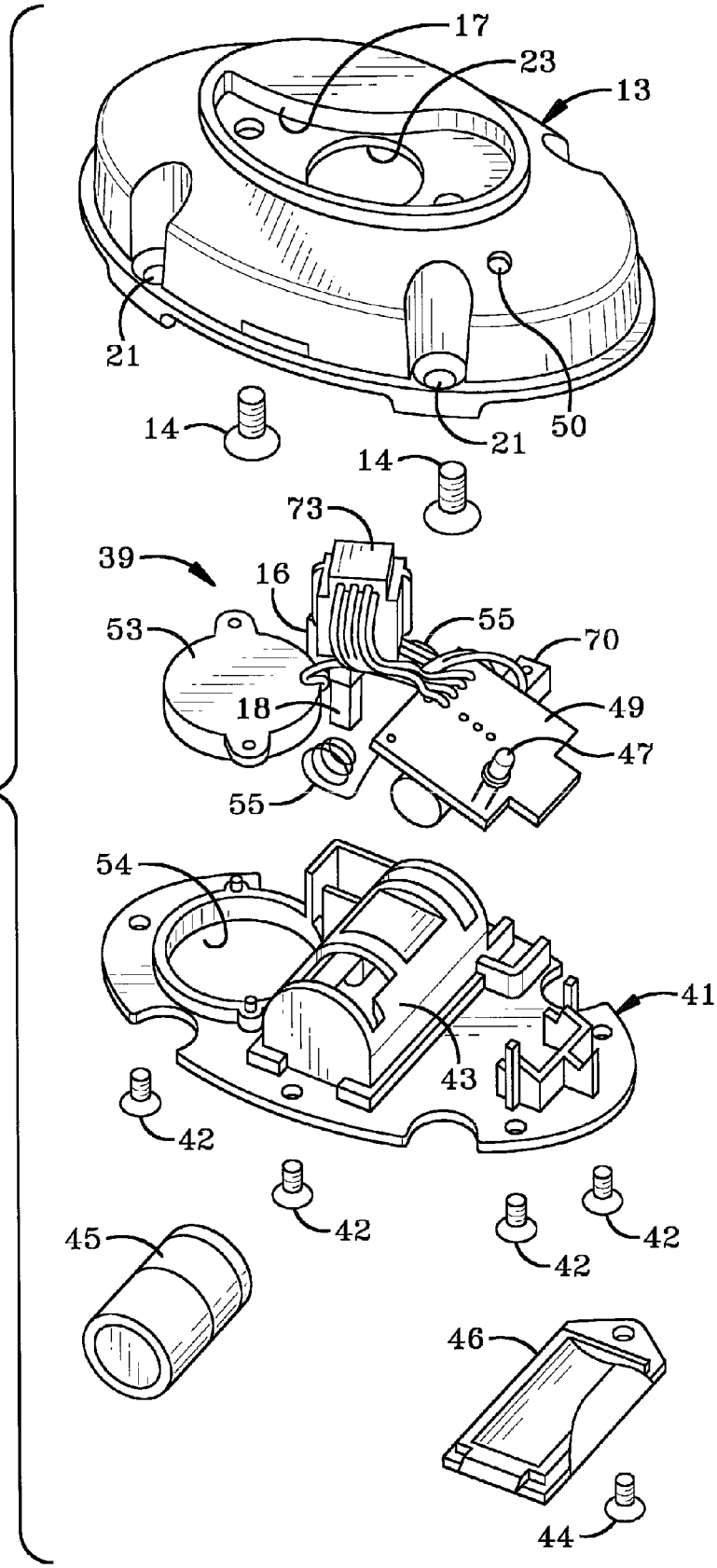

Display module 3 is intended to be secured to a support 9 by a plurality of fasteners 11 and includes a base 13 and a support column or housing 15 extending upwardly therefrom. Housing 15 is mounted within an irregular-shaped recess 17 (FIG. 2B) formed in base 13 by fasteners 14. A cover plate 19 (FIG. 2A) is formed with an oval-shaped opening 20 through which housing 15 extends. As shown in FIGS. 1 and 2B, fasteners 11 extend through a plurality of holes 21 formed in base 13 for securing the base on support surface 9. Base 13 is formed with a central hole 23 for passage of conductors therethrough for the various functions as discussed below. Referring to FIG. 2A, a platform 25 is mounted on a cap 27 by a plurality of fasteners 28 with cap 27 being formed with a cylindrical-shaped recess 29 for receiving a ring-shaped magnet 31 therein. Platform 25 is formed with a central opening 33 in which is inserted a projection 35 formed on sensor 5 (FIG. 5) which contains a second magnet 36 to provide a self-orienting type of sensor and display module arrangement such as shown and described in pending patent application Ser. No. 11/454,513. However, it is readily understood that numerous other types of sensor constructions and mounting arrangements with alarm module 3 can be utilized for removably mounting sensor 5 on top of display module 3 without affecting the concept of the invention. Display module 3 is also similar in many respects to that disclosed in pending patent application Ser. No. 11/454,513, filed Jun. 16, 2006, and Ser. No. 11/431,291, filed May 10, 2006, the contents of which are incorporated herein by reference.

Figure 3:
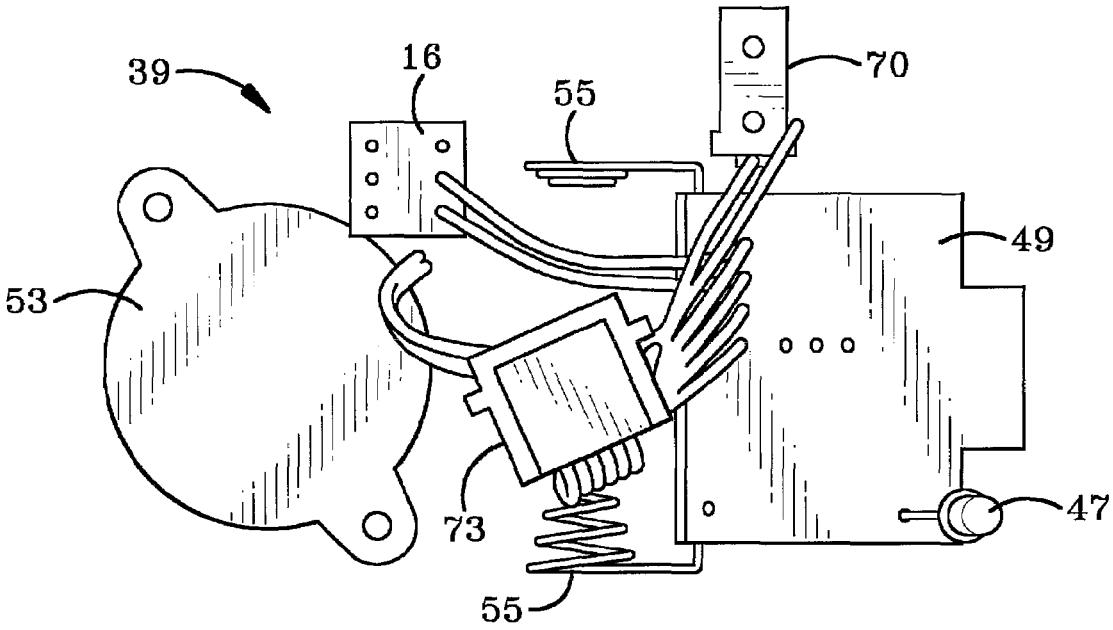
FIG. 3 is a diagrammatic top perspective view of the alarm circuitry contained in the display module of the security system.

In accordance with one of the features of the invention, display module 3 contains an alarm circuitry (FIGS. 2B and 3) which is indicated generally at 39, which is mounted on an oval-shaped mounting plate 41 which is mounted within the interior of base 13 by a plurality of fasteners 42. The alarm circuitry includes a battery housing 43 in which a battery 45 is secured by a battery closure door 46 and a fastener 44. Battery 45 is in contact with a pair of battery terminals 55. Alarm circuitry 39 further includes an LED 47 which is operationally connected to a printed circuit board microprocessor 49. LED 47 is visible through an opening 50 formed in base 13 and an aligned opening 51 formed in cover plate 19. An audible alarm such as a piezo electric alarm 53 is connected to circuit board 49 and is located within a circular hole 54 formed in mounting plate 41. The alarm circuitry also is connected to a plunger switch 16 mounted within base 13 which includes a plunger 18 which extends through a hole in mounting plate 41 and is depressed to activate the alarm when alarm module 3 is mounted on support 9 as shown in FIG. 1. The particular details of alarm circuitry 39 and printed circuit board 49 are not shown in further detail, but are well-known in the alarm art. This arrangement provides a single display module 3 with its own self-contained alarm circuit 39 powered by its own battery 45 for protecting a product 7 secured on sensor 5 as discussed further below.

In accordance with another of the features of the invention, a remote source of electric power 57 is connectable to display module 3 by a first power cord 59 which preferably contains a pair of conductors 60 and 61 and may include a pair of connectors 63 and 63A which connect cord sections 59A and 59B which combine to form power cord 59. Cord section 59B preferably extends through a hole 65 formed in support 9 and terminates in a plug 67 which has a terminal end connector 69 which extends into and is electrically connected to a power input jack 70 mounted in base 13. Power supply 57 preferably will be a usual 120V AC supply readily available throughout a retail store and usually will include a transformer 71 which will convert the 120V AC to a DC voltage, generally in the range of 3V to 9V DC, which voltage is supplied to most types of battery-powered equipment for recharging the internal battery of the type of item to be displayed on display module 3. However, this voltage can change without affecting the concept of the invention.

However, in accordance with another feature of the invention, the 120V AC power can be supplied directly to display module 3 which contains the appropriate circuitry for converting the AC voltage to a DC voltage for supplying the desired DC voltage to the displayed product as discussed further below with respect to FIG. 9. Likewise, for other applications, a greater DC voltage than the 3V to 9V discussed above could be supplied to display module 3 where this greater DC voltage is stepped down to the voltage required by the particular product secured to sensor 5.

Figures 5, 6:
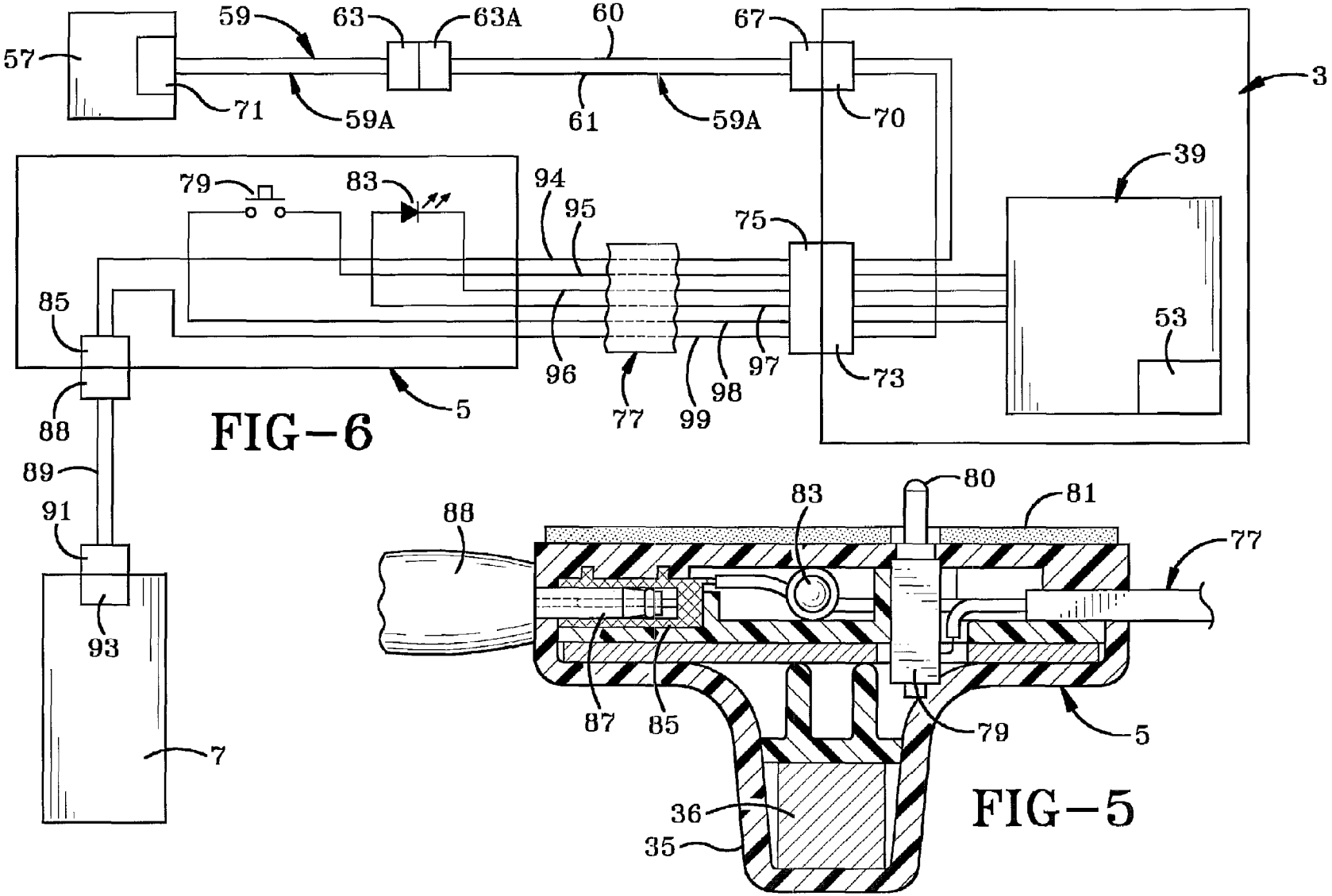
FIG. 5 is a sectional view of one type of security sensor for use with the display module of the security system of the present invention.
FIG. 6 is a diagrammatic wiring diagram of the security system of the present invention.

A power output jack 73 is mounted within housing 15 of display module 3 and receives a plug 75 therein which is mounted on one end of a second power cord 77. Power cord 77 preferably has a coiled extensional arrangement enabling it to extend outwardly when a customer is inspecting product 7 and will contain a plurality of electrical conductors. The other end of power cord 77 preferably is hardwired into sensor 5 as shown in FIG. 5, which sensor is removably seated on the upper end of housing 15. However, if desired, power cord 77 could be secured to sensor 15 by a plug-in type of attachment without affecting the concept of the invention. Sensor 5 (FIG. 5) preferably includes an internal plunger switch 79 which contains a plunger 80 which is depressed to actuate switch 79 when sensor 5 is secured to product 7 such as by a strip of pressure sensitive adhesive 81, a zip tie or various other types of attachment. If desired, an LED 83 may be incorporated into sensor 5 and connected to battery 45 of the security system as discussed further below.

A power jack 85 is mounted within sensor 5 for receiving a terminal 87 of a plug 88 therein. Plug 88 is mounted on one end of a third power cord 89 which terminates at a second end in a plug 91. Plug 91 has an end terminal configuration 92 which is configured to match the electrical contacts in the receptacle or jack 93. A receptacle or jack 93 is provided on most types of powered products, of the type intended for display on module 3, in order to charge the internal battery of the product or provide power to other components of the displayed product. A particular power cord 89 will be chosen that has a plug 91 attached thereto that is compatible with the particular receptacle 93 of the particular product to be displayed on module 1. The contacts of receptacle 93 will vary depending upon the particular manufacturer of the product in which it is incorporated and the merchant will have several types of power cords 89 that have the particular configured plug 91 on one end thereof in order to be compatible with receptacle 93 of the particular product displayed on module 3. Plug 88 preferably is a standard type of a readily available plug having a cylindrical configured terminal 87 formed therein and can be used for connection to power jack 85 incorporated in sensor 5. However, if desired, power cord 89 can be hardwired to sensor 5 without affecting its operation and manner of use.

FIG. 6 is a diagrammatic wiring diagram of one type of electrical circuit which can be used in security system 1 to provide one of the main features of the invention, that is, the supplying of electric power to displayed product 7. As shown in FIG. 6, power cord 77 preferably contains six conductors 94, 95, 96, 97, 98 and 99 which extend between power output jack 75 and sensor 5. Conductors 94 and 99 connect power input jack 70 with power output jack 73 and are connected to conductors 60 and 61 of power cord 59. These two conductors 94 and 99 continue through sensor 5 and are connected to power output jack 85 of sensor 5 and supply the electric power to the contacts of receptacle 93 of displayed product 7 through power cord 89. These conductors provide the DC power from remote power source 57 and transformer 71 to the displayed product. If desired, conductors 94 and 99 could lead directly from power input jack 70 to power output jack 75 or can be connected to the printed circuit board of alarm module 3 if desired. Conductors 95 and 98 connect to plunger switch 79 with conductors 96 and 97 being connected to LED 83.

In accordance with another feature of the invention, power supply cord 59, and in particular section 59A extending between connector 63 and power supply transformer 71 will be the same as that usually supplied with the particular product 7 to be displayed on module 3 which will ensure that the correct amount of power (DC voltage) is supplied from power supply 57 to product power input jack 93. Therefore, the display module of the present invention, in addition to removably supporting sensor 5 thereon which is attached to the displayed product, provides electrical power from a remote source to the sensor, with the sensor being mechanically and electrically connected to display module 3 by power cord 77 in a simple effective manner. This connection to the remote source of electricity enables the battery contained within the displayed product to remain charged at all times and can be used to supply electricity to other components of the displayed product making it more attractive to a perspective customer since he/she is able to see the product in its full operating condition. It also avoids sales personnel from constantly checking to see if the displayed product is supplied with the necessary internal power for satisfactory operation of its various functions. Furthermore, plunger switch 16 will provide security against unauthorized removal of the alarm module from support 9, and in combination with plunger switch 79 in sensor 5 provides the additional protection for the displayed product.

Figure 7:
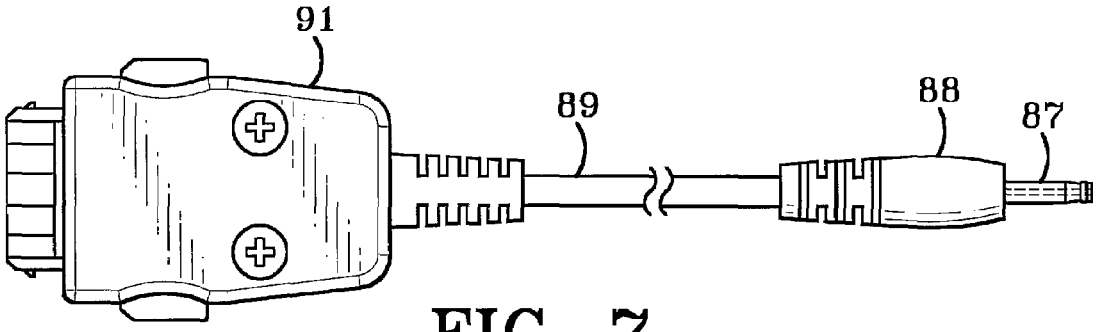
FIG. 7 is a fragmentary top plan view of one of the connecting power supply cords.
Figure 8:
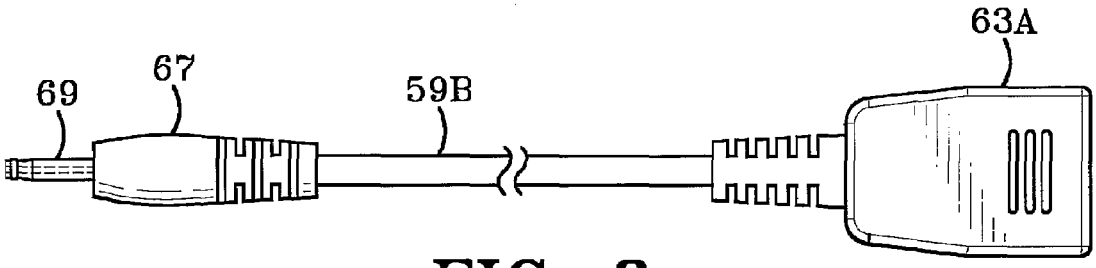
FIG. 8 is a diagrammatic top plan view of another one of the connecting power supply cords.
Figure 4:
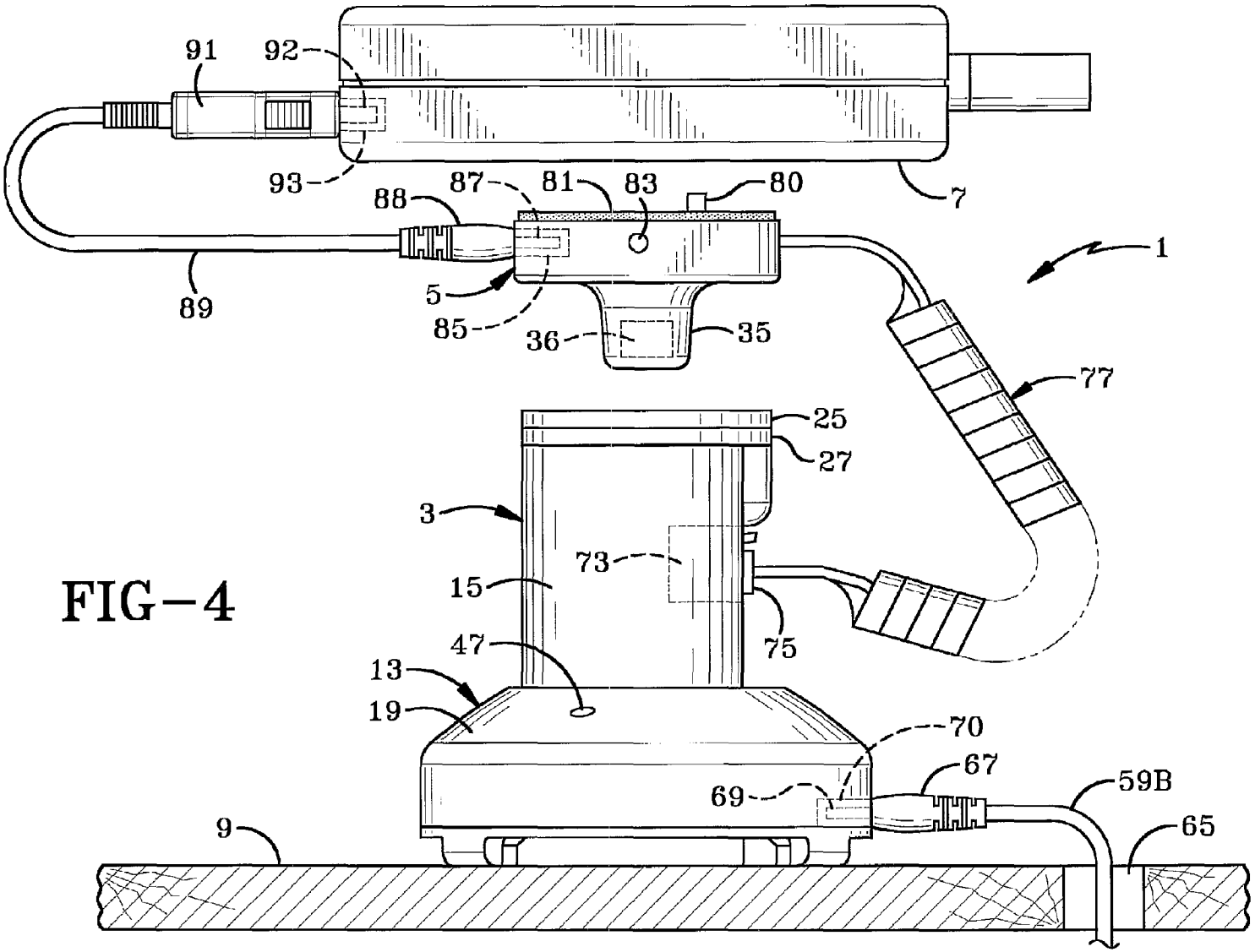
FIG. 4 is a partially exploded view of the security system and display module as shown in FIG. 1.

Thus the security system of the present invention provides a system which supplies electric power from a remote source through a display module and sensor to a product attached to the sensor to ensure that an internal battery of the displayed product remains energized, as well as supplying power at the correct voltage to other electrical components of the displayed product. As indicated above and as shown in FIGS. 1, 7 and 8, various conductors and plug configurations are utilized whereby the particular transformer 71 and plug 63, which is compatible with power input jack 93 of the displayed product, is utilized for connection to the remote power source 57 thereby ensuring that the correct voltage is supplied through transformer 71 and ultimately to product 7. Connection 63A will be chosen to be complementary to the contacts within plug 63 so as to be electrically and mechanically connected thereto as shown in FIG. 1. Plug 67 can be a standard type of plug having a cylindrical terminal 69 used for various plug configurations in combination with plug 63A for use with power input jack 70. Likewise, plug 88 can have the same cylindrical type terminal 87 for the various power cords 89 which will require a different plug 91 on the opposite end thereof for compatibility with product input jack 93. Output jack plug 75 can be a removable clip-type plug as shown in FIGS. 1 and 4, or if desired, be eliminated by hardwiring the conductors of power cord 77 to the corresponding conductors within housing 15. Likewise as discussed above, power cord 77 can be hardwired into sensor 5 or removably attached by a jack (not shown) without affecting the concept of the invention.

Also, in accordance with another feature of the invention, the self-contained alarm system 39 which includes audible alarm 53 and battery 45 is mounted within display module 3 and is dedicated to protecting the single product 7 secured to sensor 5. This protection is provided whether display module 3 is or is not connected to the remote source of electricity. This enables the display module and sensor to be placed at various locations and the product attached to sensor 5 to be periodically replaced without disturbing adjacent displayed products and alarm systems.

It is readily understood that alarm circuitry 39 will sound alarm 53 upon actuation of plunger switch 79 upon the removal of product 7 from sensor 5 or upon actuation of plunger switch 16 upon removal of alarm module 3 from support 9. Likewise, the alarm circuitry provides a sense loop through power cords 77 and 89 which will sound an alarm if plug 91 is removed from product 7 or from sensor 5, or if plug 75 is removed from power output jack 73, or if either power cord 77 or 89 is severed. The alarm circuitry can be configured that upon removal of plug 67 from input jack 70 alarm 53 will sound, all of which provides additional security to the security system of the present invention. Likewise, LEDs 47 and 83 will be fully illuminated or blinking upon the alarm system being activated, which will notify the store personnel and a potential thief that the merchandise is protected by an active alarm system.

Figure 9:
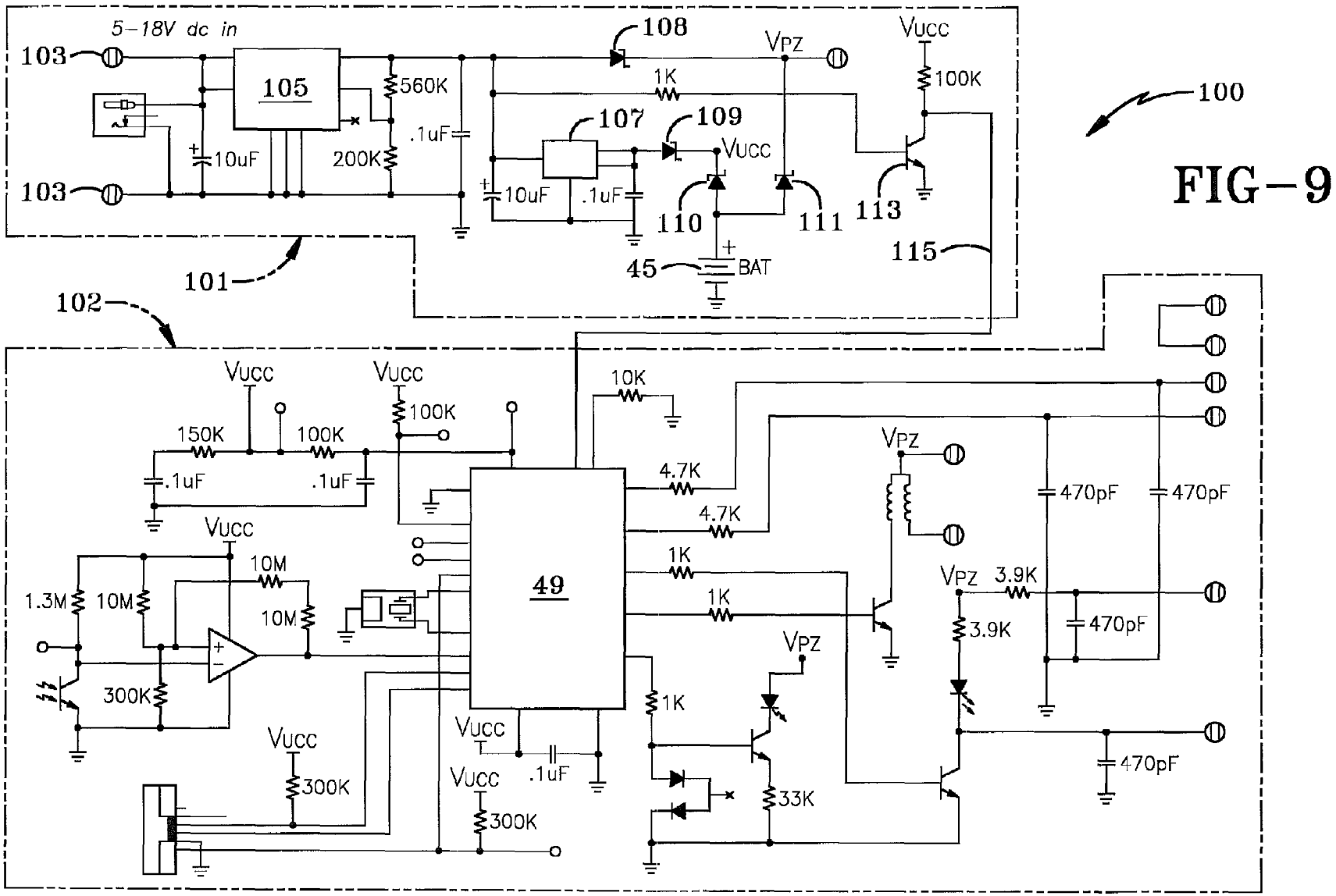
FIG. 9 is a schematic diagram of a modified circuit for the security system of the present invention.

FIG. 9 shows a modified schematic wiring diagram which can be utilized in the security system of the present invention. Electric power is supplied to the printed circuit board 49 and the alarm circuitry and in particular audible alarm 53, either from the remote 120V AC power supply or from internal battery 45. This modified schematic is indicated generally at 100, and includes two main portions 101 and 102. Circuit portion 101 contains the power supply circuitry and includes as its main components inputs 103 which connect to the remote source of 120V AC power and to a transformer (not shown) which converts this AC power to a DC voltage, for example, 5-18V DC. A linear regulator 105 converts this DC input voltage to a DC output voltage, for example 4.6V DC. Another linear regulator 107 converts this 4.6V DC to a desired DC voltage for microprocessor 49, for example 3.3V DC. Four diodes 108, 109, 110 and 111 provide a switching function as discussed below. A transistor 113 provides a signal to printed circuit board 49 through conductor 115 indicating to board 49 that it is being powered either by the external power source or internal battery 45.

Alarm circuitry 102 is a standard alarm circuitry of the type used to protect displayed products wherein a sense loop is provided in one or more conductor cables attached to the protected product and/or attached sensor or to one or more plunger or pressure switches which connect the product to a sensor or a display module to a support structure. Likewise, alarm circuitry supplies power to various visual indicators 47 and 83 (LED) as discussed above or can be used to program security codes etc. into the system, some of which are not utilized in the present invention.

In normal operation, the 120V AC supply is used to supply the desired DC voltage to printed circuit board microprocessor 49 through linear regulators 105 and 107 and other circuit components. In the event of a power failure of the 120V AC power supply, switching diodes 108-111 will immediately switch the power supply for the alarm circuitry to battery 45 which then supplies the power to circuit board 49, the various sense loops, audible alarm 53 and the various safety pressure switches. The appropriate signal is then supplied through transistor 113 and conductor 115 to circuit board 49 as discussed above. This ensures that the displayed product is protected from theft and still can be supplied with the desired DC voltage for its operation by its own internal battery even when the main AC power source is interrupted. It also avoids using battery 45 until required to protect the displayed product by using the remote source of AC power.

The 4.6V DC output of linear regulator 105 preferably is used to supply the necessary voltage to LED 83 and to the piezo speaker 53 and which will always be greater than the supply voltage, for example the 3.3V for microprocessor 49. Also, the DC power supply from remote AC source, preferably will always be higher than the DC voltage of 4.6 provided by the output of linear regulator 105.

In the foregoing description, certain terms have been used for brevity, clearness, and understanding. No unnecessary limitations are to be implied therefrom beyond the requirement of the prior art because such terms are used for descriptive purposes and are intended to be broadly construed. The term "mechanically connected" as used herein means that the power cord provides a physical attachment between the separate items or components in addition to providing an electrical path therebetween.

Moreover, the description and illustration of the invention is an example and the invention is not limited to the exact details shown or described.

The invention claimed is:

1. A security system for displaying and protecting a displayed product comprising:

a display module mounted on a support;

a sensor removably seated on the display module and connected to the displayed product;

a remote source of electric power;

a first power cord electrically connecting the display module to the source of electric power;

a second power cord electrically and mechanically connecting the display module to the sensor;

a third power cord electrically and mechanically connecting the sensor to the displayed product;

said first, second and third power cords providing an electrical path extending from the remote source of electric power through the display module to the displayed product; and an alarm circuit contained in the display module providing sense loops through the second and third power cords, and an audible alarm for sounding an alarm upon the integrity of either of said second and third power cords being compromised.

2. The security system defined in claim 1 wherein a power input jack is contained in the display module and is connected to a first end of the first power cord; and in which a power output jack is contained in the display module and is connected to a first end of the second power cord.

3. The security system defined in claim 2 wherein the power input jack and power output jack are electrically connected within the display module.

4. The security system defined in claim 1 wherein the third power cord has first and second ends; and in which said first end is connected to the sensor by a first releasable connector and in which the second end is connected to the displayed product by a second releasable connector.

5. The security system defined in claim 1 wherein the second power cord has first and second ends, with said first end being hardwired to the sensor; and in which the second end is releasably connected to the display module.

6. The security system defined in claim 1 wherein the alarm circuit contains a visual indicator indicating that the alarm circuit is activated.

7. The security system defined in claim 1 wherein the second power cord is an expandable coiled lanyard.

8. The security system defined in claim 1 wherein the second power cord contains six conductors; in which first and second conductors of said six conductors are electrically connected to the remote source of electric power and to the displayed product to provide electric power to said product.

9. The security system defined in claim 8 wherein third and fourth conductors of the six conductors are electrically connected to a security switch mounted in the sensor; and in which fifth and sixth conductors of the six conductors are electrically connected to a visual indicator mounted in the sensor.

10. The security system defined in claim 1 wherein the display module contains a battery providing a power source for the alarm circuit.

11. The security system defined in claim 10 wherein the alarm circuit includes a switching device for supplying power to the alarm circuit from either the remote source of electric power or from the battery.

12. The security system defined in claim 11 wherein the switching device is a plurality of diodes and automatically switches the power for the alarm circuit from the remote source of electric power to the battery upon interruption of said remote source of electric power.

13. The security system defined in claim 1 wherein the remote source of power provides the operating power for the alarm circuit.

14. A security display module for displaying an item of merchandise comprising:

a display stand;

an alarm system mounted within the display stand including an audible alarm and a power source for powering said audible alarm;

a sensor removably seated on the display stand for connection to the item of merchandise;

a first power cord mechanically and electrically connecting the display stand to the sensor;

a second power cord for mechanically and electrically connecting the sensor to the item being displayed; and said alarm system being actuated to sound the audible alarm upon the integrity of either of the first or second power cords being compromised.

15. The display module defined in claim 14 wherein the display stand includes a base adapted to be secured to a support structure by fasteners, and a housing attached to and extending upwardly from the base.

16. The display module defined in claim 15 wherein a first magnet is mounted in the display stand housing and magnetically aligns with a second magnet mounted in the sensor when the sensor is seated in the display stand, to automatically place the sensor in a desired orientation on the display stand.

17. The display module defined in claim 15 wherein a switch is mounted in the base of the display stand and includes an actuator adapted to engage the support structure for actuating the alarm when the base is removed from the support structure.

18. The display module defined in claim 14 wherein a power input connector is provided in the display stand; and in which a third power cord is attached to said power input connector and to a remote source of electric power for supplying electric power through the first, second and third power cords to the item being displayed.

19. The display module defined in claim 18 wherein a power output connector is provided on the display stand and is connected to a first end of the first power cord; and in which the power input connector is electrically connected to the power output connector in the display stand.

20. The display module defined in claim 14 wherein the remote source of electric power provides the power source for powering the audible alarm.

21. The display module defined in claim 14 in which the sensor includes a visual indicator for indicating that the alarm system is activated.

22. The display module defined in claim 14 wherein the sensor includes a plunger switch for engagement with the displayed item when the item is attached to the sensor.

23. The display module defined in claim 14 wherein the display stand contains a battery providing the power source for powering the audible alarm.

24. The display module defined in claim 23 wherein the display module is adapted to be connected to an external AC power source which is the power source for powering the audible alarm; and in which the alarm system includes a switching circuit for automatically switching from the external AC power source to the battery upon interruption of the AC power source for powering the audible alarm.

25. A security system for displaying and protecting a displayed product comprising:

a display module mounted on a support;

a sensor removably seated on the display module and connected to the displayed product;

a remote source of electric power electrically connected to the display module;

a first power cord electrically and mechanically connecting the display module to the sensor;

a second power cord electrically and mechanically connecting the sensor to the displayed product;

said first and second power cords providing an electrical path extending from the remote source of electric power through the display module to the displayed product;

an alarm circuit contained in the display module providing sense loops through the first and second power cords, and an audible alarm for sounding an alarm upon the integrity of either of said first and second power cords being compromised; and a switching device electrically connected to the alarm circuit including a battery for automatically connecting the alarm circuit to the battery upon interruption of the remote source of electric power.

26. A security system for an item of merchandise comprising:

a power source;

a display stand;

a sensor removably supported on the display stand and operable to be attached to the item of merchandise;

a first power cord electrically connecting the display stand to the sensor;

a second power cord electrically connecting the sensor to the item of merchandise; and an alarm circuit disposed within at least one of the display stand and the sensor; said alarm circuit activating an alarm upon the integrity of the first power cord being compromised.

27. The security system defined in claim 26 wherein a first magnet is mounted in the display stand and magnetically aligns with a second magnet mounted in the sensor when the sensor is supported on the display stand to automatically position the sensor in a desired orientation on the display stand.

28. The security system defined in claim 26 wherein the display stand is adapted to be secured to a support by at least one fastener.

29. The security system defined in claim 28 wherein a switch is mounted on the display stand and includes an actuator adapted to engage the support for actuating the alarm when the display stand is removed from the support.

30. The security system defined in claim 26 wherein a power input connector is provided on the display stand; and in which a third power cord is attached to said power input connector and to a remote source of electric power for supplying electric power through the first, second and third power cords to the item of merchandise.

31. The security system defined in claim 30 wherein a power output connector is provided on the display stand and is connected to a first end of the first power cord, and in which the power input connector is electrically connected to the power output connector within the display stand.

32. The security system defined in claim 26 in which the sensor includes a visual indicator for indicating that the alarm circuit is activated.

33. The security system defined in claim 26 wherein the sensor includes a switch for engagement with the item of merchandise when the item of merchandise is attached to the sensor.

34. The security system defined in claim 26 wherein the display stand contains a battery providing the power source for powering the alarm circuit.

35. The security system defined in claim 34 wherein the display stand is adapted to be electrically connected to an external AC power source which is the power source for powering the alarm; and in which the alarm circuit includes a switching circuit for automatically switching from the external AC power source to the battery for powering the alarm circuit upon interruption of the AC power source.

36. A security system for protecting a displayed product comprising:

a display module adapted to be mounted on a support;

a sensor removably seated on the display module and adapted to be attached to the displayed product;

a power source;

a first power cord electrically connecting the display module to the power source;

a second power cord electrically connecting the display module to the sensor;

a third power cord electrically connecting the sensor to the displayed product; said first, second and third power cords providing an electrical path extending from the power source through the display module to the displayed product;

an alarm circuit contained in one of the display module and the sensor providing a sense loop through at least the second power cord; and an alarm that is activated upon the integrity of at least the second power cord being compromised.

37. The security system defined in claim 36 wherein a power input jack is provided on the display module for connection to a first end of the first power cord; and in which a power output jack is provided on the display module for connection to a first end of the second power cord.

38. The security system defined in claim 37 wherein the power input jack and power output jack are electrically connected within the display module.

39. The security system defined in claim 36 wherein the third power cord has first and second ends; and in which the first end of the third power cord is connected to the sensor by a first releasable connector and in which the second end of the third power cord is connected to the displayed product by a second releasable connector.

40. The security system defined in claim 36 wherein the second power cord has first and second ends, with the first end of the second power cord is releasably connected to the display module, and in which the second end of the second power cord is hardwired to the sensor.

41. The security system defined in claim 36 wherein the second power cord is an expandable coiled lanyard.

42. The security system defined in claim 36 wherein at least the second power cord and the third power cord comprise first and second conductors that are electrically connected to the power source and to the displayed product to provide electric power to the displayed product.

43. The security system defined in claim 36 wherein the display module contains a battery providing a source of power for powering the alarm circuit.

44. The security system defined in claim 43 wherein the alarm circuit includes a switching device for supplying power to the alarm circuit from the battery.

* * * * *